United States Patent [19]

Perkins

[11] 4,445,575

[45] May 1, 1984

[54] BOREHOLE CEMENTING OVER WATER

[75] Inventor: Thomas K. Perkins, Dallas, Tex.

[73] Assignee: Atlantic Richfield Company, Los Angeles, Calif.

[21] Appl. No.: 330,061

[22] Filed: Dec. 14, 1981

[51] Int. Cl.[3] ..... E21B 33/13

[52] U.S. Cl. ..... 166/290; 166/285

[58] Field of Search ..... 166/285, 290, 291, 292

[56] References Cited

U.S. PATENT DOCUMENTS

| | | | |
|---|---|---|---|
| 2,546,252 | 3/1951 | Bankson | 166/285 |
| 3,884,302 | 5/1975 | Messenger | 166/291 |
| 4,190,110 | 2/1980 | Beirute | 166/291 |
| 4,275,788 | 6/1981 | Sweatman | 166/285 |

FOREIGN PATENT DOCUMENTS

| | | | |
|---|---|---|---|
| 47801 | 3/1974 | U.S.S.R. | 166/290 |

OTHER PUBLICATIONS

"Injection Process for Sealing Water Sands," by K. C. Schlater, *The Petroleum Engineer,* 1936.

*Primary Examiner*—Stephen J. Novosad
*Assistant Examiner*—William P. Neuder
*Attorney, Agent, or Firm*—Albert C. Metrailer

[57] ABSTRACT

A borehole cementing process in which a quantity of water-like fluid is pumped into a borehole above drilling mud and the cement slurry is pumped into the borehole above at least a portion of the water-like fluid. Turbulent mixing of cement slurry and water at the interface creates an isolation zone preventing degradation of the bulk of the cement slug.

3 Claims, 1 Drawing Figure

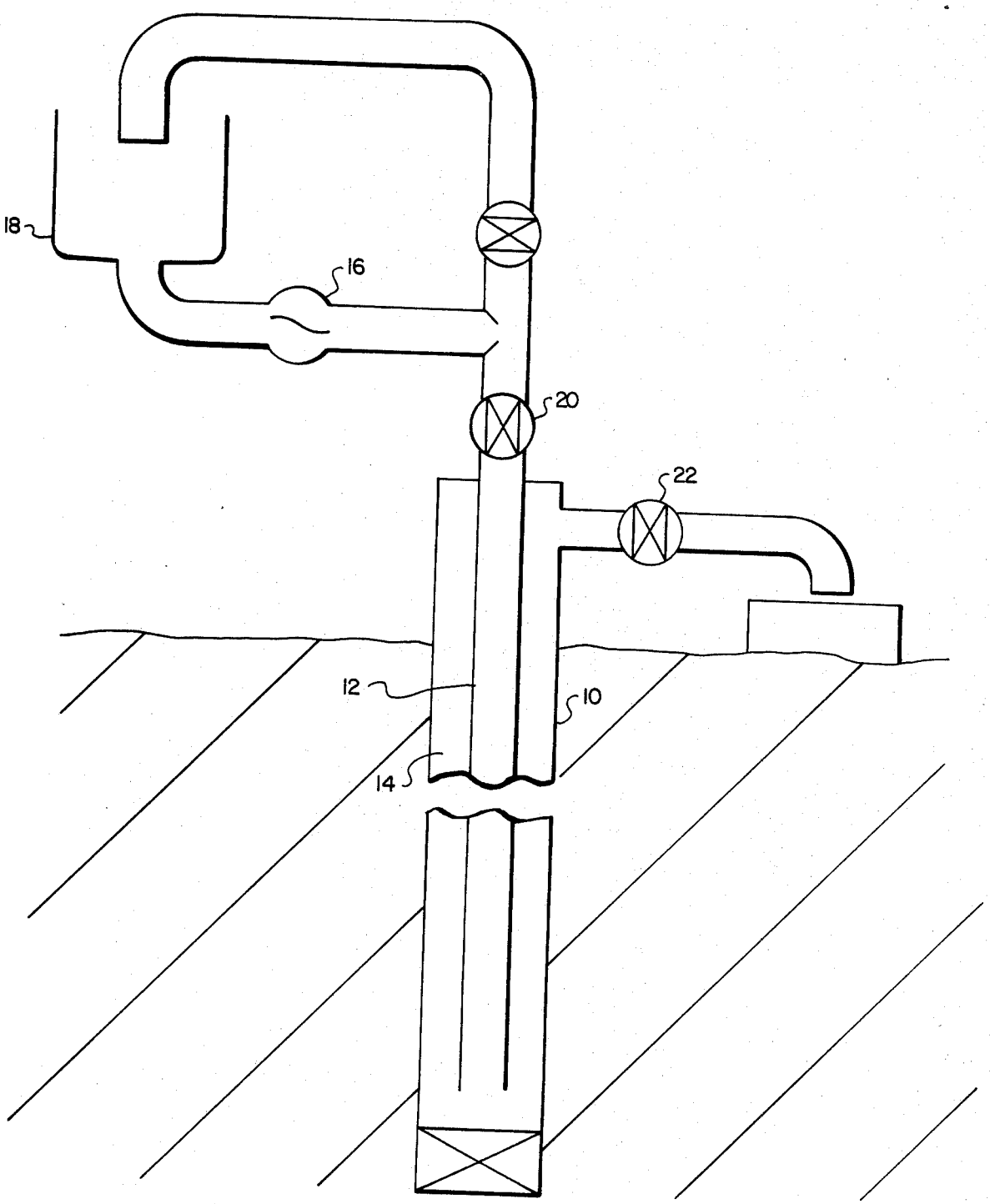
18
16
20
22
12
10
14

BOREHOLE CEMENTING OVER WATER

BACKGROUND OF THE INVENTION

The present invention relates to methods of placing cement plugs in boreholes and more particularly, to a method for improving the integrity of such cement plugs when placed above low density drilling mud.

The methods and purposes for cementing portions of boreholes are well known. The annulus between surface casing and the borehole wall is normally filled with cement to seal off and prevent communication between aquifers. In this way, contamination of fresh water aquifers is avoided. For similar reasons, the annulus between deeper casing sections may also be cemented. In some cases, it is desirable to set a solid plug in the borehole to isolate a zone either for testing purposes or to protect lower portions of the borehole while various operations are completed above the plug. In many of these situations, the borehole below that portion being cemented is filled only with drilling mud. Quite often, that drilling mud is of a density lower than that of the cement slurry which is to be pumped into the borehole.

Drilling muds generally contain various thickening or jelling agents to increase the viscosity of the drilling mud to aid in carrying cuttings up the annulus during drilling operations. Other materials are normally added to drilling muds to increase the density of the mud to maintain downhole pressures at safe levels. If the drilling mud density is greater than that of a cement slurry which is to be placed above the mud, it can be seen that there would be little chance of loss of the cement slurry prior to hardening or of mixing between the slurry and the mud. However, in many cases, the mud density is less than that of the cement. It has normally been assumed that the increased viscosity of the drilling mud would prevent mixing between the cement slurry and the mud and would cause an interface to form which would maintain the integrity of the cement slug while it is set. However, experience has shown that in many such cementing operations, a substantial portion of the cement is lost or "falls" down the annulus or borehole through the drilling mud.

SUMMARY OF THE INVENTION

Accordingly, an object of the present invention is to provide an improved method of cementing a borehole.

Another object of the present invention is to provide a method of placing cement in a borehole above a less dense fluid while substantially maintaining the integrity of the cement slug.

A cementing operation, according to the present invention, includes the steps of pumping a water-like fluid into the borehole to be cemented and then pumping the cement slurry into the borehole above the water-like fluid. In an embodiment where the cement is placed in an annulus by pumping down a tubing, the process includes lifting the tubing by a preselected distance after placement of water in the borehole.

BRIEF DESCRIPTION OF THE DRAWINGS

The present invention may be better understood by reading the following detailed description of the preferred embodiments with reference to the accompanying drawing which is a cross-sectional view of a typical borehole and also illustrates a test well used in the experimental procedure discussed below.

DESCRIPTION OF THE PREFERRED EMBODIMENTS

To fully appreciate the present invention, it is important to recognize the mechanism which causes failure of cementing operation in prior art methods. As noted above, cement plugs have often been lost or at least found to be of very little quality when placed above low density drilling mud even though the muds were of high viscosity. I believe that the high viscosity of the drilling muds does substantially prevent mixing of the mud with the cement slurry placed above it. However, I now believe that this is the cause of the loss of integrity of the cement plug. Due to the lack of mixing, a laminar flow situation is created between the cement slurry and the underlying drilling mud. The heavier cement slurry tends to flow in a laminar manner, for example, down one side of an annulus while the lower density drilling mud flows up the other side of the annulus. Once such circulation begins, the drilling mud can penetrate through the entire zone being cementing in a short time. As a result, either the entire cement slug may be lost or at least continous flow paths are produced through the cement slug by the mud. In either case, the cementing operation is a failure.

The present invention is based upon my discovery that reduction in viscosity of the drilling mud so that it will mix with the cement slurry makes it possible to place a cement slug above a lower density drilling mud and maintain it in position while the cement sets. The invention was originally tested using three 16 foot long vertical sections of clear PVC tubing having nominal diameters of one-half inch, one inch and one and one half inches. In each case, the upper half of the tubing was filled with cement slurry while the lower half was filled with water. A ball valve was used to separate upper and lower halves of each test section prior to beginning of each test. Upon opening of each ball valve, the growth of a mixing zone in which the cement slurry penetrated into the water zone was measured with time. The results in the case of the half inch nominal tube (actually, 0.602 inch I.D.) proved to be of no value in the experiment because coarse particles of gilsonite in the cement caused bridging in the mixing zone. The results of the other two experiments (actual inner diameters of 1.03 inches and 1.60 inches) showed turbulent mixing of the cement slurry with water with a growth rate of the mixed zone decreasing with time. These tests results indicated that the mixing zone of the cement into the water would move downward approximately 120 feet in an annulus having 1.6 inch gap width during an eight hour period. The laboratory tests were carried out for only a one hour period at the end of which, it was found that nearly one-half of the slurry remained in the top half of the test columns. The tests also showed that essentially the same percentages remained for both the one inch and the and one and one-half inch tubings.

In view of the positive laboratory results, an experiment more closely representing actual field conditions was performed. This experiment will be described with respect to the FIGURE. The experiment was carried out within a cased test borehole 10 having a depth of over 200 feet and outer diameter of four inches. A 200 foot length of two inch inner diameter plastic tubing 12 was positioned within the borehole 10. Tubing 12 and annulus 14 surrounding tubing 12 were initially filled with water. As illustrated, a pump 16 and mixing tub 18 were connected for initially mixing a cement slurry and then pumping cement down tubing 12. Valves 20 and 22 were provided for controlling flow to or sealing off tubing 12 and annulus 14. A quantity of cement sufficient to fill 108.5 feet of tubing was pumped down tubing 12. Tubing valve 20 was then closed and several seconds later, valve 22 was closed. The system was allowed to sit for twenty-four hours after which the tubing was pulled and cut into sections for examination of the results. Apparently due to the sequence in which valves 20 and 22 were closed or failure of these valves to totally seal, it was found that the upper 40 feet of tubing 12 was filled with air. The next 80 feet of tubing 12 was filled with hard cement. Below the hard cement was a 22 foot length of unset cement having a putty-like consistency. Below the unset cement was a 2 foot section of tubing having a cement skin on its inner surface and water in the center. The lowest 56 feet of tubing was filled with water. Thus, only 28.5 feet of the cement column pumped into the tubing 12 initially was lost or contaminated by mixing with the underlying water. Samples of cement taken from the mixing tub 18 and poured into molds took a soft set in approximately three hours. It is assumed that once such a soft set occurs, further contamination of the cement column by water would not occur. Extrapolation of the one hour laboratory tests would have indicated that up to fifty feet of the column could have been contaminated with water or lost to the bottom during the three hour initial set-up period.

It will be appreciated that most cementing operations involve pumping of a cement slurry down a casing or tubing 12 and circulation back up annulus 14 to the desired location of the final cement plug. Had this type of operation been performed in the test borehole 10, it would not have been possible to pull the cement plug for inspection as was done in the above-described experiment.

In such normal cementing operations, an additional step should be performed, the process would begin with annulus 14 and probably tubing 12 filled with a drilling mud. A quantity of water or water-like fluid would then be pumped down tubing 12 to circulate back up annulus 14. As noted above, test results indicate that approximately 50 feet of cement might be lost during a typical cement set-up time period. As a result, I would recommend pumping sufficient water to fill at least 50 feet of borehole 10 with water. During the pumping of water, drilling mud below the lower end of tubing 12 will typically be undisturbed and drilling mud in the annulus 14 will be displaced upward. Therefore, after the water slug has been pumped, it will essentially all be positioned above the lower end of tubing 12. Before pumping of cement slurry, the tubing 12, or casing, as the case may be, should be lifted to a point near the top of the water slug or at least about fifty feet above the lower end of the water slug. Thus, if desired, a water slug filling 100 feet or more of borehole could be pumped so that after lifting tubing 12 fifty feet, the bottom end of the tubing would then be positioned at the center of the water slug. Once tubing 12 has been positioned so that the desired length of water-like fluid is positioned below the lower end thereof, the cement slurry may be pumped down tubing 12 and back up annulus 14. As shown by our experimental results, turbulent mixing of cement slurry and the underlying water will maintain the integrity of the major portion of the cement slug.

In some circumstances, it is required or desirable that the annulus 14 be filled with cement by pumping down the annulus 14. In such a case, the cement should also be preceded by a water slug filling at least about 50 feet of annulus 14. Considerably larger quantities of water may be used if desired and would generally aid in washing the drilling mud from the outer surface of tubing or casing 12 and the walls of borehole 10. In this type of downsqueeze operation, there is, of course, no need to move the tubing or casing 12 before the cement is placed.

In the above descriptions, the terms "water" and "water-like fluid" are used interchangeably. Either of these terms is intended to mean a fluid distinct from drilling mud primarily in having a low viscosity like water as distinguished from the high viscosity of drilling muds. It is apparent that various additives to adjust acidity or salinity of water may be required to avoid damage to formations surrounding borehole 10. The fluid should be one in which cement is readily dispersed to encourage turbulent mixing at the cement-water interface. It is expected that the water-like fluid density would be about 8.3 pounds per gallon (PPG) or slightly heavier. Drilling mud density which would be involved in practice of the present invention would be expected to range from 8.5 to 17 PPG. Cement slurry density would be expected to range between 15 and 18 PPG.

While the present invention has been illustrated and described with respect to particular apparatus and methods, it is apparent that various modifications and changes can be made with the scope of the present invention as defined by the appended claims.

What is claimed is:

1. In a process of cementing a portion of a borehole where said borehole is filled, below the portion to be cemented, with drilling mud of lower density than the cement, the improvement comprising:

pumping a quantity of water-like fluid into said borehole above said drilling mud, said quantity being sufficient to fill at least about fifty feet of said borehole below that portion of said borehole which is to be filled with cement, and pumping a quantity of cement into said borehole above the portion of said water-like fluid filling said at least about fifty feet of said borehole.

2. In a process of cementing a portion of a borehole where said borehole is filled, below the portion to be cemented, with drilling mud of lower density than the cement, the improvement comprising:

pumping a quantity of water-like fluid sufficient to fill at least about fifty feet of said borehole down a casing positioned in said borehole with its lower end at least about fifty feet below said portion to be cemented while circulating fluid back up the annulus between said casing and said borehole, raising said casing at least about fifty feet, pumping a quantity of cement down said casing while circulating fluid back up the annulus between said casing and said borehole.

3. In a process of cementing a portion of a borehole where said borehole is filled, below the portion to be cemented, with drilling mud of lower density than the cement, the improvement comprising:

pumping a quantity of water-like fluid down an annulus between a casing in said borehole and the borehole wall, said quantity of water-like fluid being sufficient to fill at least about fifty feet of said annulus, and pumping a quantity of cement down said annulus above said water-like fluid.

* * * * *